US010825638B2

(12) United States Patent
Ishii et al.

(10) Patent No.: US 10,825,638 B2
(45) Date of Patent: Nov. 3, 2020

(54) X-RAY TUBE

(71) Applicant: HAMAMATSU PHOTONICS K.K., Hamamatsu-shi, Shizuoka (JP)

(72) Inventors: Atsushi Ishii, Hamamatsu (JP); Tutomu Inazuru, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 16/380,105

(22) Filed: Apr. 10, 2019

(65) Prior Publication Data

US 2019/0318900 A1 Oct. 17, 2019

(30) Foreign Application Priority Data

Apr. 12, 2018 (JP) ..... 2018-077001

(51) Int. Cl.
*H01J 35/08* (2006.01)
*H01J 35/16* (2006.01)

(52) U.S. Cl.
CPC ..... *H01J 35/112* (2019.05); *H01J 35/16* (2013.01); *H01J 2235/165* (2013.01)

(58) Field of Classification Search
CPC .. H01J 35/16; H01J 2235/16; H01J 2235/165; H01J 35/112
See application file for complete search history.

(56) References Cited

U.S. PATENT DOCUMENTS 2,845,559 A 7/1958 Lempert
4,322,653 A 3/1982 Bader et al.
4,618,977 A * 10/1986 Brettschneider ..... H01J 35/16 378/121
5,077,771 A 12/1991 Skillicorn et al.
7,031,433 B2 4/2006 Suzuki et al.
7,058,161 B2 6/2006 Inazuru et al.
7,110,505 B2 9/2006 Suzuki et al.
7,773,726 B2 8/2010 Inazuru
2007/0258565 A1 * 11/2007 Tomita ..... H01J 35/14 378/138

(Continued)

FOREIGN PATENT DOCUMENTS

CN 1069438 C 8/2001
DE 195 36 247 A1 4/1997
EP 1 052 674 A1 11/2000

(Continued)

*Primary Examiner* — Chih-Cheng Kao

(74) *Attorney, Agent, or Firm* — Faegre Drinker Biddle & Reath LLP

(57) ABSTRACT

An X-ray tube includes a rod-shaped anode which includes a target receiving electrons and generating X-rays and has a main body portion extending in a direction of a tube axis; a vacuum housing which accommodates a distal end side of the anode having the target disposed therein and in which a proximal end side of the anode is fixed by a housing coupling portion; and a cover electrode which is disposed inside the vacuum housing, is coupled to the anode by a cover coupling portion, and surrounds the housing coupling portion. The anode has a third diameter increasing portion protruding from a front surface of the main body portion in a direction intersecting the tube axis. The cover coupling portion is disposed closer to the proximal end side of the anode than the third diameter increasing portion.

9 Claims, 5 Drawing Sheets

(56) References Cited

U.S. PATENT DOCUMENTS

2015/0139404 A1* 5/2015 Smith ..... H01J 35/16
378/140

FOREIGN PATENT DOCUMENTS

| | | | |
|---|---|---|---|
| EP | 1 437 757 | A1 | 7/2004 |
| JP | S37-28601 | Y1 | 10/1962 |
| JP | S50-092669 | U | 8/1975 |
| JP | S57-25660 | A | 2/1982 |
| JP | S57-121139 | A | 7/1982 |
| JP | S61-22545 | A | 1/1986 |
| JP | S63-18757 | U | 2/1988 |
| JP | H03-110753 | A | 5/1991 |
| JP | H04-149940 | A | 5/1992 |
| JP | H07-029487 | A | 1/1995 |
| JP | H07-0296751 | A | 11/1995 |
| JP | H10-255653 | A | 9/1998 |
| JP | 2000-268753 | A | 9/2000 |
| JP | 2001-23557 | A | 1/2001 |
| JP | 2003-132826 | A | 5/2003 |
| JP | 2004-207161 | A | 7/2004 |
| JP | 4068332 | B2 | 3/2008 |
| JP | 4712727 | B2 | 6/2011 |
| WO | WO-03/036676 | A1 | 5/2003 |

* cited by examiner

X-RAY TUBE

TECHNICAL FIELD

An embodiment of the present invention relates to an X-ray tube.

BACKGROUND

Japanese Patent No. 4068332, Japanese Patent No. 4712727, and Japanese Unexamined Patent Publication No. S57-25660 disclose technologies related to X-ray tubes. The technology disclosed in Japanese Patent No. 4068322 is related to improvement of accuracy in assembling components constituting an X-ray tube. The technology disclosed in Japanese Patent No. 4712727 is related to curbing of occurrence of electric discharge performed by simplifying the structure of an X-ray tube. The technology disclosed in Japanese Unexamined Patent Publication No. S57-25660 is related to controlling of an X-ray dose with high accuracy.

The X-ray tubes of Japanese Patent No. 4068322, Japanese Patent No. 4712727, and Japanese Unexamined Patent Publication No. S57-25660 have a potential difference between a housing and an anode. Due to the potential difference, electrons emitted from an electron gun are guided to a target provided in the anode. A high voltage for generating a potential difference is applied to the anode. When a high voltage is applied to the anode, an electric field having a high intensity is generated around the anode. As a result, unnecessary electric discharge is likely to occur between the anode and the housing.

An object of the present invention is to provide an X-ray tube capable of curbing electric discharge.

SUMMARY

According to an embodiment of the present invention, there is provided an X-ray tube including a rod-shaped anode including a main body portion extending in a direction of an axis line and a target generating X-rays upon receiving electrons; a vacuum housing which accommodates a distal end side of the anode having the target disposed therein and in which a proximal end side of the anode is fixed by a housing coupling portion; and a cover electrode which is disposed inside the vacuum housing, is coupled to the anode by a cover coupling portion, and surrounds the housing coupling portion. The anode has a flange portion protruding from a front surface of the main body portion in a direction intersecting the axis line. The cover coupling portion is disposed closer to the proximal end side of the anode than the flange portion.

DETAILED DESCRIPTION

Figure 1:
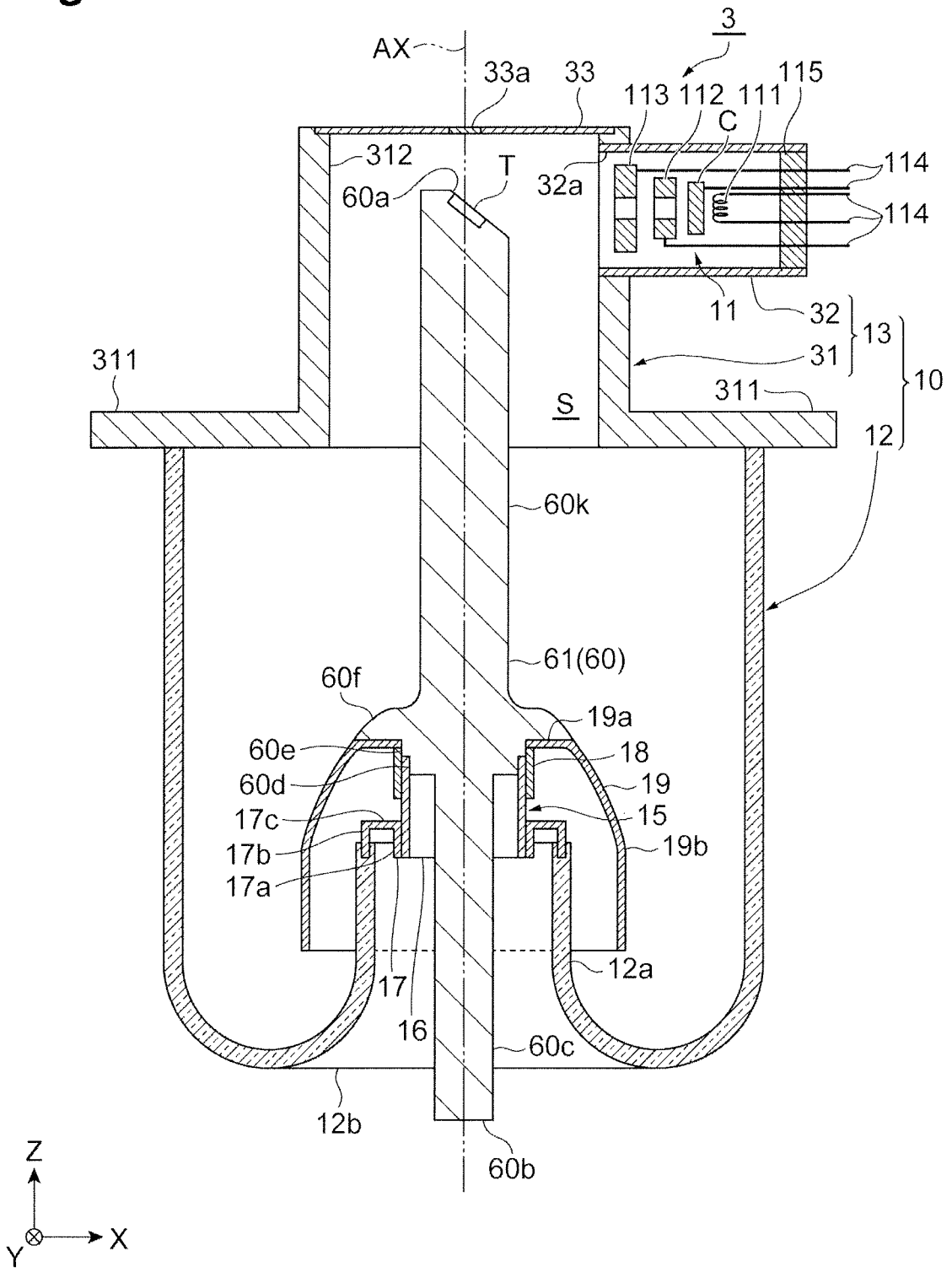
FIG. 1 is a cross-sectional view illustrating a configuration of an X-ray tube.

According to an embodiment of the present invention, there is provided an X-ray tube including a rod-shaped anode including a main body portion extending in a direction of an axis line and a target generating X-rays upon receiving electrons; a vacuum housing which accommodates a distal end side of the anode having the target disposed therein and in which a proximal end side of the anode is fixed by a housing coupling portion; and a cover electrode which is disposed inside the vacuum housing, is coupled to the anode by a cover coupling portion, and surrounds the housing coupling portion. The anode has a flange portion protruding from a front surface of the main body portion in a direction intersecting the axis line. The cover coupling portion is disposed closer to the proximal end side of the anode than the flange portion.

The state of an electric field generated inside the vacuum housing is affected by the shape of the front surface of a fixing portion of each member. The housing coupling portion of the X-ray tube fixes the anode to the vacuum housing. The housing coupling portion is surrounded by the cover electrode. On the other hand, the cover electrode is fixed to the anode by the cover coupling portion. The cover coupling portion is disposed closer to the proximal end side of the anode than the flange portion provided in the anode. As a result, these fixing portions are covered with electrodes. Therefore, influences of the fixing portions on an electric field can be alleviated. As a result, a local increase in the intensity of an electric field is curbed. That is, electric discharge can be curbed.

In the X-ray tube, the flange portion and the cover electrode may come into contact with each other. According to this configuration, the flange portion and the cover electrode approach each other. As a result, electric fields around the flange portion and the cover electrode are easily stabilized.

In the X-ray tube, an outer surface of the flange portion may include a first main surface exposed to an inner space of the vacuum housing. An outer surface of the cover electrode may include a second main surface exposed to the inner space of the vacuum housing. The first main surface and the second main surface may be included in the same virtual curved surface. According to this configuration, a boundary between the flange portion and the cover electrode becomes smooth. Therefore, an influence of the boundary part on an electric field can be alleviated. As a result, a local increase in the intensity of an electric field is further curbed. That is, electric discharge can be further curbed.

In the X-ray tube, the cover coupling portion may be surrounded by the cover electrode. According to this configuration, an electric field around the cover coupling portion can be further stabilized.

In the X-ray tube, the cover coupling portion may join the cover electrode to the flange portion. According to this configuration, the cover coupling portion can be covered with the flange portion. Moreover, the cover electrode can be stably fixed.

In the X-ray tube, the housing coupling portion may include a housing coupling member fixed to the vacuum housing, and an anode coupling member fixed to the anode. The anode coupling member may be fixed to the housing coupling member. Sometimes internal stress is generated when the vacuum housing and the anode are coupled to each other. According to this configuration, the housing coupling member and the anode coupling member can bear the internal stress. Therefore, generation of unnecessary deformation and stress in the vacuum housing and the anode can be curbed.

In the X-ray tube, the vacuum housing may include an inner cylinder portion extending inward along the axis line. An inside of the inner cylinder portion and an inside of the vacuum housing may be isolated from each other by the anode and the housing coupling portion provided in one end portion of the inner cylinder portion. A part in which the anode coupling member is joined to the housing coupling member may be disposed inside the inner cylinder portion. According to this configuration, the part in which the anode coupling member is joined to the housing coupling member is disposed inside the inner cylinder portion. Therefore, a cooling medium can easily enter the inside of the inner cylinder portion from the outside. As a result, heat generated in the anode can be efficiently discharged.

According to the present invention, an X-ray tube capable of curbing electric discharge is provided.

Hereinafter, an embodiment for performing the present invention will be described in detail with reference to the accompanying drawings. The same reference signs are applied to the same elements in description of the drawings, and duplicated description will be omitted.

A configuration of an X-ray tube 3 will be described. As illustrated in FIG. 1, the X-ray tube 3 is a so-called reflective X-ray tube. The X-ray tube 3 includes a vacuum housing 10, an electron gun 11, and a target T. The vacuum housing 10 is a vacuum envelope internally maintaining a vacuum state. The electron gun 11 is an electron generation unit. The electron gun 11 has a cathode C. For example, the cathode C has a base body which is formed of a high melting-point metal material or the like and a substance which has been impregnated in the base body and easily emits electrons. The target T has a plate shape. For example, the target T is formed of a high melting-point metal material such as tungsten. A position at the center of the target T overlaps a tube axis AX of the X-ray tube 3. The electron gun 11 and the target T are accommodated inside the vacuum housing 10. Electrons emitted from the electron gun 11 are incident on the target T. As a result, the target T generates X-rays. The generated X-rays are radiated outside through an X-ray emission window 33*a*.

The vacuum housing 10 has an insulation valve 12 and a metal portion 13. The insulation valve 12 is formed of an insulating material. Examples of an insulating material include glass. The metal portion 13 has the X-ray emission window 33*a*. The metal portion 13 has a main body portion 31 (metal housing portion) and an electron gun accommodation portion 32. The main body portion 31 accommodates the target T serving as an anode. The electron gun accommodation portion 32 accommodates the electron gun 11 serving as a cathode.

The main body portion 31 has a tubular shape. The main body portion 31 has an inner space S. A lid plate 33 is fixed to one end portion (outer end portion) of the main body portion 31. The lid plate 33 has the X-ray emission window 33*a*. The material of the X-ray emission window 33*a* is an X-ray transmission material. Examples of an X-ray transmission material include beryllium and aluminum. The lid plate 33 closes one end side of the inner space S. The main body portion 31 has a flange portion 311 and a cylinder portion 312. The flange portion 311 is provided in the outer circumference of the main body portion 31. The flange portion 311 is fixed to an X-ray generation device (not illustrated). The cylinder portion 312 is formed on one end portion side of the main body portion 31. The cylinder portion 312 has a cylindrical shape.

The electron gun accommodation portion 32 has a cylindrical shape. The electron gun accommodation portion 32 is fixed to a side portion of the main body portion 31 on one end portion side. The center axis line of the main body portion 31 is substantially orthogonal to the center axis line of the electron gun accommodation portion 32. In other words, the tube axis AX of the X-ray tube 3 is substantially orthogonal to the center axis line of the electron gun accommodation portion 32. An opening 32*a* is provided in an end portion of the electron gun accommodation portion 32 on the main body portion 31 side. The inside of the electron gun accommodation portion 32 communicates with the inner space S of the main body portion 31 through the opening 32*a*.

The electron gun 11 includes the cathode C, a heater 111, a first grid electrode 112, and a second grid electrode 113. In the electron gun 11, the beam diameter of an electron beam generated in cooperation with the constituent components can be reduced. In other words, the electron gun 11 can perform micro-focusing of an electron beam. The cathode C, the heater 111, the first grid electrode 112, and the second grid electrode 113 are attached to a stem substrate 115 with a plurality of power feeding pins 114 interposed therebetween. The plurality of power feeding pins 114 extend in a manner of being parallel to each other. The cathode C, the heater 111, the first grid electrode 112, and the second grid electrode 113 receive electric power from the outside with the corresponding power feeding pins 114 interposed therebetween.

The insulation valve 12 has a substantially tubular shape. One end side of the insulation valve 12 is joined to the main body portion 31. An inner cylinder portion 12*a* is provided on the other end side of the insulation valve 12. The inner cylinder portion 12*a* extends to the inner side of the insulation valve 12. In addition, the inner cylinder portion 12*a* has a cylindrical shape. The other end portion of the insulation valve 12 is folded back to the inner side throughout the whole circumference, such that a hole portion is defined in a middle portion of the insulation valve 12 when viewed in a Z-direction.

The inner cylinder portion 12*a* of the insulation valve 12 holds an anode 61 (target supporting portion 60) with a housing coupling portion 15 (fixing portion) interposed therebetween. The target T is fixed to the distal end side of the target supporting portion 60. The target supporting portion 60 has a rod shape. In addition, the target supporting portion 60 has a columnar shape. For example, the target supporting portion 60 is formed of a copper material or the like. The target supporting portion 60 extends in the Z-direction. An inclined surface 60*a* is formed on the distal end side of the target supporting portion 60. The inclined surface 60*a* is inclined away from the electron gun 11 while going from the insulation valve 12 side toward the main body portion 31 side. The target T is buried in an end portion of the target supporting portion 60. The target T is flush with the inclined surface 60*a*.

A proximal end portion 60*b* of the target supporting portion 60 protrudes outward beyond a lower end portion of the insulation valve 12. The proximal end portion 60*b* of the target supporting portion 60 is the distal end portion on the proximal end side. The proximal end portion 60*b* of the anode 61 protrudes outward beyond a folded-back position. The proximal end portion 60*b* of the target supporting portion 60 (anode 61) is connected to a power source (not illustrated). In the present embodiment, the vacuum housing 10 (metal portion 13) is the ground potential. Therefore, the metal portion 13 has the ground potential. The anode 61 (target supporting portion 60) receives a high positive voltage from the power source. The anode 61 may receive a voltage from the power source in a form different from a high positive voltage.

The proximal end portion 60*b*, a columnar portion 60*c*, a first diameter increasing portion 60*d*, a second diameter increasing portion 60*e*, and a third diameter increasing portion 60*f* are formed in this order on the proximal end side of the target supporting portion 60 (anode 61). Each of the columnar portion 60*c*, the first diameter increasing portion 60*d*, the second diameter increasing portion 60*e*, and the third diameter increasing portion 60*f* has a columnar shape. The proximal end side of the target supporting portion 60 may be stipulated as the proximal end side of the anode 61. The third diameter increasing portion 60*f* may be stipulated as the flange portion. The proximal end side of the target supporting portion 60 is connected to an extending portion 60*k*. The extending portion 60*k* extends toward the distal end side (inclined surface 60*a* side). The proximal end side of the target supporting portion 60 may be stipulated as the proximal end side of the anode 61. The distal end side may be stipulated as the inclined surface 60*a* side. The first diameter increasing portion 60*d* has a cylindrical shape. The first diameter increasing portion 60*d* may have a ring shape. The outer diameter of the first diameter increasing portion 60*d* is longer than the outer diameter of the columnar portion 60*c*. The outer diameter of the first diameter increasing portion 60*d* is a diameter of a cross section in a direction perpendicular to the tube axis AX. The second diameter increasing portion 60*e* has a cylindrical shape. The second diameter increasing portion 60*e* may have a ring shape. The outer diameter of the second diameter increasing portion 60*e* is much longer than the outer diameter of the first diameter increasing portion 60*d*. The third diameter increasing portion 60*f* has a cylindrical shape. The third diameter increasing portion 60*f* may have a ring shape. The outer diameter of the third diameter increasing portion 60*f* is much longer than the outer diameter of the second diameter increasing portion 60*e*. The outer diameter of the third diameter increasing portion 60*f* is the longest of the outer diameters in the target supporting portion 60 (anode 61). The outer diameter of the third diameter increasing portion 60*f* is longer than the inner diameter of the inner cylinder portion 12*a* of the insulation valve 12. The inner diameter of the inner cylinder portion 12*a* is the diameter of the hole portion provided in the middle portion of the insulation valve 12. The proximal end side of the target supporting portion 60 is inserted through the insulation valve 12. The proximal end side of the target supporting portion 60 may be stipulated as the proximal end side of the anode 61. The outer diameter of the third diameter increasing portion 60*f* may be smaller than the inner diameter of the inner cylinder portion 12*a* of the insulation valve 12.

The housing coupling portion 15 is formed of a metal or the like. The housing coupling portion 15 has a first fixing portion 16 and a second fixing portion 17. The first fixing portion 16 and the second fixing portion 17 fix the anode 61 (target supporting portion 60) to the other end portion of the insulation valve 12. The first fixing portion 16 has a cylindrical shape. The inner diameter of the first fixing portion 16 substantially coincides with the outer diameter of the first diameter increasing portion 60*d*. The outer diameter of the first fixing portion 16 substantially coincides with the outer diameter of the second diameter increasing portion 60*e*. The first diameter increasing portion 60*d* is inserted through one end portion of the first fixing portion 16. The first fixing portion 16 is fixed to the target supporting portion 60 (anode 61).

The second fixing portion 17 has an inner cylinder portion 17*a*, an outer cylinder portion 17*b*, and a connection portion 17*c*. The inner diameter of the inner cylinder portion 17*a* substantially coincides with the outer diameter of the first fixing portion 16. The diameter of the outer cylinder portion 17*b* substantially coincides with the diameter of the inner cylinder portion 12*a* of the insulation valve 12. In the connection portion 17*c*, an upper end of the inner cylinder portion 17*a* is connected to an upper end of the outer cylinder portion 17*b*. The connection portion 17*c* has a toric shape when viewed in the Z-direction. The lower end portion of the outer cylinder portion 17*b* is fused such that it is inserted into the end surface of the other end portion of the insulation valve 12. The other end portion thereof is the upper end portion of the inner cylinder portion 12*a*. The inner cylinder portion 17*a* is fixed to the first fixing portion 16. The first fixing portion 16 is inserted through the inner cylinder portion 17*a*. The position at the lower end of the inner cylinder portion 17*a* substantially coincides with the position at the lower end of the first fixing portion 16. The first fixing portion 16 is fixed to the target supporting portion 60 (anode 61). The first fixing portion 16 is joined to the inner cylinder portion 17*a*. The anode 61 (target supporting portion 60) is fixed to the other end portion of the insulation valve 12 with the first fixing portion 16 and the second fixing portion 17 interposed therebetween.

The housing coupling portion 15 has a third fixing portion 18 (cover coupling portion). The third fixing portion 18 fixes a cover electrode 19 to the anode 61 (target supporting portion 60). The cover electrode 19 is an electrode member. The cover electrode 19 covers a part in which the inner cylinder portion 12*a* of the insulation valve 12 is fused into the outer cylinder portion 17*b* of the second fixing portion 17, from the outside. The fused part may be stipulated as a part in which the inner cylinder portion 12*a* is joined to the outer cylinder portion 17*b*. The cover electrode 19 prevents damage to the insulation valve 12. Damage to the insulation valve 12 is caused due to electric discharge to the fused part. The cover electrode 19 has a ring portion 19*a* and an outer circumferential portion 19*b*. The ring portion 19*a* comes into contact with a lower surface of the third diameter increasing portion 60*f*. The outer circumferential portion 19*b* constitutes a surrounding surface of the cover electrode 19. The surrounding surface may be stipulated as an outer circumferential surface. The inner diameter of the ring portion 19*a* substantially coincides with the outer diameter of the second diameter increasing portion 60*e*. The second diameter increasing portion 60*e* is inserted through the ring portion 19*a*. The third fixing portion 18 has a cylindrical shape. The inner diameter of the third fixing portion 18 substantially coincides with the outer diameter of the second diameter increasing portion 60*e*. The third fixing portion 18 is fitted to a part of the second diameter increasing portion 60*e* and the first fixing portion 16. A part of the second diameter increasing portion 60*e* and the first fixing portion 16 is inserted through the third fixing portion 18. The ring portion 19*a* is pressed to the third diameter increasing portion 60*f* by the third fixing portion 18. The cover electrode 19 is fixed to the anode 61 (target supporting portion) with the third fixing portion 18 interposed therebetween.

Figure 2:
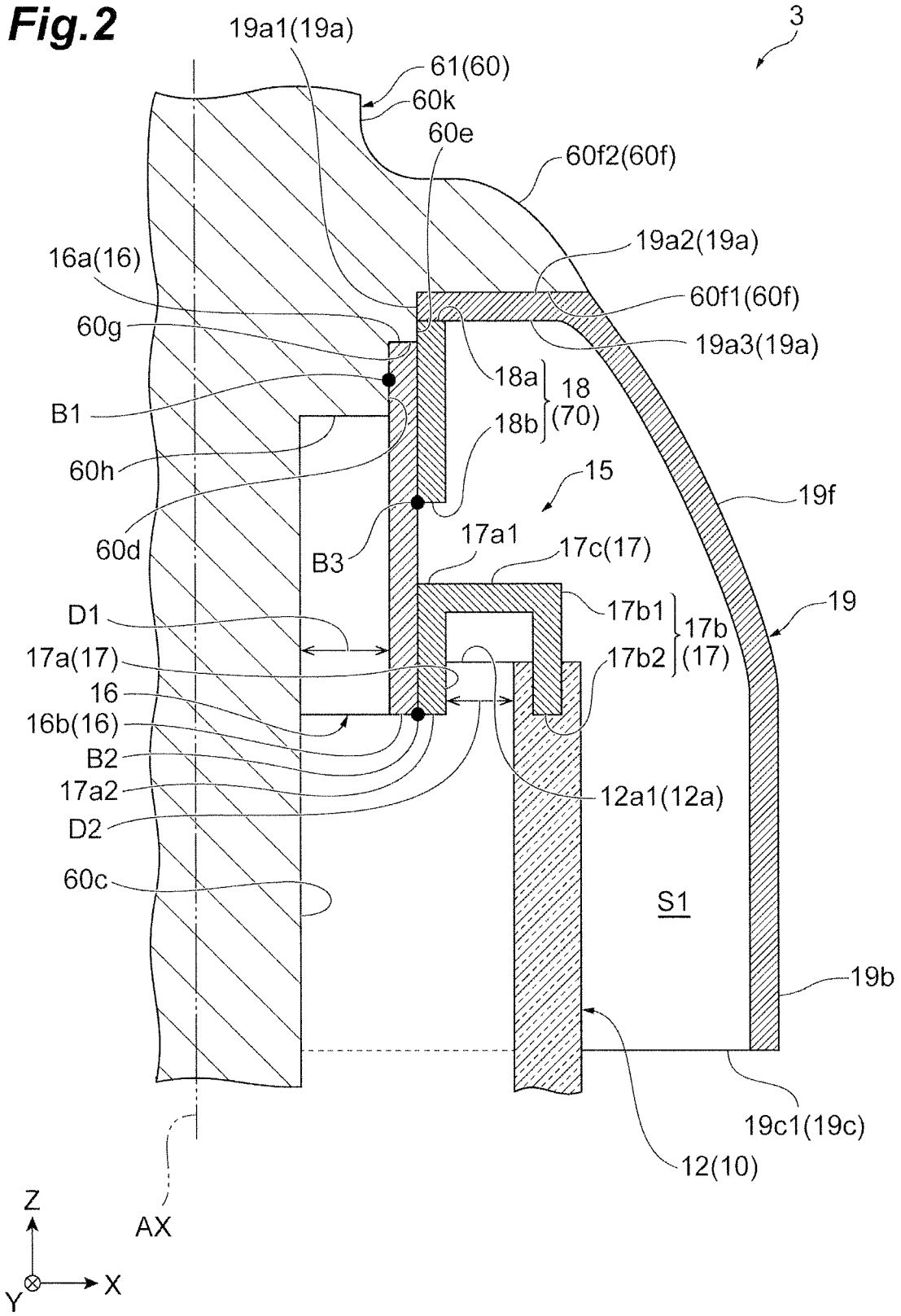
FIG. 2 is an enlarged cross-sectional view illustrating a housing coupling portion and a cover coupling portion.

Hereinafter, with reference to FIG. 2, the housing coupling portion 15 will be described in more details. The housing coupling portion 15 causes the anode 61 and the vacuum housing 10 to be coupled to each other. In the following description, an inner circumferential surface is a surface on the tube axis AX side. The outer circumferential surface is a surface on a side opposite to the tube axis AX side.

The housing coupling portion 15 has the first fixing portion 16 (anode coupling member) and the second fixing portion 17 (housing coupling member). The first fixing portion 16 is fixed to the anode 61 (target supporting portion 60) by a joint portion B1. The joint portion B1 is formed through brazing, welding, or the like. The second fixing portion 17 is fixed to the insulation valve 12. The first fixing portion 16 is fixed to the second fixing portion 17 by a joint portion B2. The joint portion B2 is formed through brazing, welding, or the like. The anode 61 (target supporting portion 60) is fixed to the insulation valve 12 with the first fixing portion 16 and the second fixing portion 17 interposed therebetween. According to the housing coupling portion 15, the length of the columnar portion 60*c* exposed to the outside of the vacuum housing 10 can be elongated. A cooling medium provided from the outside comes into contact with the columnar portion 60*c*. For example, the cooling medium is an insulating oil. According to this configuration, a contact area contributing to heat transfer increases. Therefore, heat can be efficiently transferred from the anode 61 (target supporting portion).

The first fixing portion 16 has a cylindrical shape. The first diameter increasing portion 60*d* is inserted into an end portion 16*a* of the first fixing portion 16. The end portion 16*a* comes into contact with an end surface 60*g* of the anode 61 (target supporting portion 60). Depending on the end portion 16*a* and the end surface 60*g* being in contact with each other, the position of the first fixing portion 16 with respect to the anode 61 (target supporting portion 60) in a direction of the tube axis AX is determined. The joint portion B1 is provided between the first fixing portion 16 and the first diameter increasing portion 60*d*. The joint portion B1 is formed through brazing, welding, or the like. The first fixing portion 16 is fixed to the first diameter increasing portion 60*d*.

The length of the first fixing portion 16 along the tube axis AX is longer than the length of the first diameter increasing portion 60*d* along the tube axis AX. The first fixing portion 16 protrudes to the proximal end portion 60*b* side beyond an end surface 60*h*. The inner circumferential surface of the first fixing portion 16 includes a part facing the first diameter increasing portion 60*d* and a part facing the columnar portion 60*c*. The outer diameter of the columnar portion 60*c* is smaller than the outer diameter of the first diameter increasing portion 60*d*. A gap D1 is formed between the first fixing portion 16 and the columnar portion 60*c*. According to the gap D1, the contact area between the anode 61 (target supporting portion 60) and the cooling medium increases. For example, the cooling medium is an insulating oil. Therefore, heat is easily transferred to the cooling medium from the anode 61 (target supporting portion).

The second fixing portion 17 is an integrated component. The second fixing portion 17 has the inner cylinder portion 17*a*, the outer cylinder portion 17*b*, and the connection portion 17*c*.

The inner cylinder portion 17*a* has a cylindrical shape. An end portion 17*a*1 is connected to the connection portion 17*c*. The first fixing portion 16 is inserted into the inner cylinder portion 17*a*. An end portion 16*b* of the first fixing portion 16 is inserted from the end portion 17*a*1 of the inner cylinder portion 17*a*. The end portion 16*b* of the first fixing portion 16 is substantially flush with an end portion 17*a*2 of the inner cylinder portion 17*a*. The entire inner circumferential surface of the inner cylinder portion 17*a* faces the outer circumferential surface of the first fixing portion 16. The outer circumferential surface of the inner cylinder portion 17*a* faces the outer cylinder portion 17*b* and the inner cylinder portion 12*a* of the insulation valve 12. For example, the outer diameter of the inner cylinder portion 17*a* is smaller than the inner diameter of the inner cylinder portion 12*a* of the insulation valve 12. Therefore, a gap D2 is formed between the inner cylinder portion 17*a* and the inner cylinder portion 12*a* of the insulation valve 12.

The outer cylinder portion 17*b* has a cylindrical shape. One end portion 17*b*1 of the outer cylinder portion 17*b* is connected to the connection portion 17*c*. An end portion 12*a*1 of the insulation valve 12 is connected to an end portion 17*b*2. The size of the outer cylinder portion 17*b* in a radial direction corresponds to the size of the inner cylinder portion 12*a* of the insulation valve 12. The end portion 17*b*2 of the outer cylinder portion 17*b* faces the end portion 12*a*1 of the inner cylinder portion 12*a* of the insulation valve 12. The end portion 17*b*2 is fused into the insulation valve 12. The end portion 17*b*2 is fixed such that it is buried on the end surface of the insulation valve 12. Therefore, the thickness of the outer cylinder portion 17*b* is smaller than the thickness of the insulation valve 12.

The end portion 17*a*2 is connected to the end portion 16*b* of the first fixing portion 16. For example, the joint portion B2 is formed in a part in which the end portion 17*a*2 and the end portion 16*b* are connected to each other. The connected part is positioned on an opening side on the inner side of the inner cylinder portion 12*a* of the insulation valve 12. According to this position, workability of connection work is improved.

A high voltage is applied from an external power source to the anode 61 (target supporting portion) with the proximal end portion 60*b* interposed therebetween. Due to this voltage, a strong electric field is generated around the anode 61 (target supporting portion). The first fixing portion 16 and the second fixing portion 17 are metal components. Therefore, a high voltage is also applied to the first fixing portion 16 and the second fixing portion 17. As a result, a state in which electric discharge is likely to occur is generated around the housing coupling portion 15. A distribution of an electric field is affected by the shape of the housing coupling portion 15 or the like. For example, the intensity of an electric field is likely to increase in a right-angled corner portion. Therefore, in the vicinity of the corner portion included in the housing coupling portion 15, the intensity of an electric field is likely to increase. For example, the intensity of an electric field is likely to increase near the corner portion between the outer cylinder portion 17*b* and the connection portion 17*c* of the second fixing portion 17. When the intensity of an electric field increases, a possibility of electric discharge increases. Therefore, the cover electrode 19 is provided in order to alleviate the intensity of an electric field generated around the shapes thereof. The cover electrode 19 is fixed to the anode 61 (target supporting portion 60). In addition, the cover electrode 19 is electrically connected to the anode 61 (target supporting portion 60). Therefore, the potential of the cover electrode 19 is the same as the potential of the anode 61 (target supporting portion 60) and the potential of the housing coupling portion 15.

The cover electrode 19 has a cylindrical shape. In the external shape of the cover electrode 19, the proximal end side having a cylindrical shape and the distal end side reduced in diameter in a substantially conical shape are smoothly connected to each other. The cover electrode 19 has an inner space S1 having substantially the same shape.

The distal end portion of the cover electrode 19 comes into contact with the anode 61 (target supporting portion 60). The ring portion 19*a* is fixed to the anode 61 (target supporting portion 60) by a cover coupling portion 70.

A proximal end portion 19*c* on a side opposite to the ring portion 19*a* has an opening 19*c*1. The proximal end portion 19*c* on the other side is positioned closer to the proximal end portion 60*b* side than the end portion 16*b* of the first fixing portion 16 in the direction of the tube axis AX. The proximal end portion 19*c* is positioned closer to the proximal end portion 60*b* side than the end portion 17*a*2 of the second fixing portion 17 in the direction of the tube axis AX. The first fixing portion 16 and the second fixing portion 17 are positioned in the inner space S1 of the cover electrode 19. The entire housing coupling portion 15 is positioned in the inner space S1 of the cover electrode 19.

The cover electrode 19 covers the housing coupling portion 15.

The cover electrode 19 has an opening 19*a*1 provided in the ring portion 19*a*. The second diameter increasing portion 60*e* of the anode 61 (target supporting portion 60) is inserted into the opening 19*a*1. A main surface 19*a*2 of the ring portion 19*a* surrounding the opening 19*a*1 is a flat surface having a ring shape. The main surface 19*a*2 comes into contact with a rear surface 60*f*1 of the third diameter increasing portion 60*f*. That is, the main surface 19*a*2 comes into surface contact with the rear surface 60*f*1 of the third diameter increasing portion 60*f*. The rear surface 60*f*1 of the third diameter increasing portion 60*f* is a surface on the proximal end side of the target supporting portion 60. Depending on the ring portion 19*a* being in contact with the rear surface 60*f*1, the position of the cover electrode 19 with respect to the anode 61 (target supporting portion 60) in the direction of the tube axis AX is determined. The rear surface 60*f*1 of the third diameter increasing portion 60*f* is a positioning portion of the cover electrode 19.

When the rear surface 60*f*1 is viewed in the direction of the tube axis AX, the rear surface 60*f*1 has an annular flat surface shape surrounding the second diameter increasing portion 60*e*. When the ring portion 19*a* is viewed in the direction of the tube axis AX, the shape of the ring portion 19*a* corresponds to the shape of the rear surface 60*f*1. The inner diameter of the rear surface 60*f*1 is substantially equivalent to the inner diameter of the ring portion 19*a*. In other words, the outer diameter of the second diameter increasing portion 60*e* is substantially equivalent to the inner diameter of the opening 19*a*1. The outer diameter of the rear surface 60*f*1 is substantially equivalent to the outer diameter of the ring portion 19*a*. That is, the maximum outer diameter of the third diameter increasing portion 60*f* is substantially equivalent to the outer diameter of the ring portion 19*a*. The outer diameter of the ring portion 19*a* indicates the length from the tube axis AX to a part in which the ring portion 19*a* and a front surface 19*f* of the cover electrode 19 are connected to each other. The ring portion 19*a* does not protrude from the third diameter increasing portion 60*f* in a direction intersecting the tube axis AX. The third diameter increasing portion 60*f* has a front surface 60*f*2. In a boundary between the front surface 60*f*2 and the cover electrode 19, the front surface 60*f*2 forms a smooth surface which is substantially connected to the front surface 19*f* of the cover electrode 19. In other words, the third diameter increasing portion 60*f* has the first main surface in a boundary between the third diameter increasing portion 60*f* and the cover electrode 19. The first main surface is included on the same virtual curved surface as the front surface 19*f* of the cover electrode 19. The front surface 60*f*2 (first main surface) of the third diameter increasing portion 60*f* protrudes from the front surface of the extending portion 60*k* of the anode 61 (target supporting portion 60) in a cross section in a direction along the tube axis AX. In other words, the first main surface of the third diameter increasing portion 60*f* protrudes from the front surface of the extending portion 60*k* of the target supporting portion 60 in a cross section in the direction along the tube axis AX. Then, the front surface 60*f*2 is a smooth surface of which the shape changes to the rear surface 60*f*1 in a substantially continuous manner. Moreover, the shape of the front surface 60*f*2 is realized by cutting a projection smoothly protruding from the front surface of the anode 61 (target supporting portion 60), at a predetermined position along its protruding direction. In other words, the shape of the front surface 60*f*2 is a cross section of a projection smoothly protruding from the front surface of the target supporting portion 60, viewed at a predetermined position.

The cover coupling portion 70 will be described. The cover coupling portion 70 causes the cover electrode 19 to be attached to the anode 61 (target supporting portion 60). The cover electrode 19 is fixed to the anode 61 (target supporting portion 60) by the third fixing portion 18 constituting the cover coupling portion 70. The third fixing portion 18 has a cylindrical shape. The second diameter increasing portion 60*e* of the anode 61 (target supporting portion 60) is inserted into an end portion 18*a* of the third fixing portion 18. The end portion 18*a* comes into contact with a rear surface 19*a*3 of the ring portion 19*a*.

The length of the third fixing portion 18 along the tube axis AX is longer than the length of the second diameter increasing portion 60*e* along the tube axis AX. The inner circumferential surface of the third fixing portion 18 includes a part in contact with the outer circumferential surface of the second diameter increasing portion 60*e* and a part in contact with the outer circumferential surface of the first fixing portion 16. An end portion 18*b* of the third fixing portion 18 is fixed to the first fixing portion 16 by a joint portion B3. The joint portion B3 is formed through brazing, welding, or the like. The end portion 18*b* of the third fixing portion 18 protrudes to the proximal end portion 60*b* side beyond the lower end surface of the first diameter increasing portion 60*d*. The end portion 18*b* of the third fixing portion 18 is not in contact with the second fixing portion 17. The end portion 18*b* of the third fixing portion 18 is away from the connection portion 17*c* in the direction of the tube axis AX. The end portion 18*b* of the third fixing portion 18 does not necessarily protrude to the proximal end portion 60*b* side beyond the lower end surface of the first diameter increasing portion 60*d*. For example, the end portion 18*b* of the third fixing portion 18 may be at a position opposing the first diameter increasing portion 60*d*.

The inner diameter of the third fixing portion 18 is substantially equivalent to the inner diameter of the opening 19*a*1 of the ring portion 19*a*. The outer diameter of the third fixing portion 18 is larger than the inner diameter of the opening 19*a*1 of the ring portion 19*a*. The end portion 18*a* of the third fixing portion 18 comes into contact with the rear surface 19*a*3 of the ring portion 19*a*. An edge portion of the ring portion 19*a* on the opening 19*a*1 side is sandwiched between the rear surface 60*f*1 of the third diameter increasing portion 60*f* and the end portion 18*a* of the third fixing portion 18. Due to this sandwiching structure, the cover electrode 19 is fixed to the target supporting portion 60 closer to the proximal end side (proximal end portion 60*b* side) of the anode 61 than the third diameter increasing portion 60*f* (flange portion). In other words, the cover electrode 19 is fixed to the target supporting portion 60 closer to the proximal end portion 60*b* side of the anode 61 than the flange portion. The cover electrode 19 of the cover coupling portion 70 is not directly fixed to the anode 61 (target supporting portion 60) through joining such as brazing or welding. The cover coupling portion 70 is not limited to this structure. Other parts of the structure of the cover coupling portion 70 will be described below.

Operational Effects

Hereinafter, operational effects of the X-ray tube 3 according to the embodiment will be described.

The X-ray tube 3 includes the rod-shaped anode 61 (target supporting portion 60) which includes the main body portion extending in the direction of the tube axis AX and the target T generating X-rays upon receiving electrons; the vacuum housing 10 which accommodates the distal end side of the anode 61 (target supporting portion 60) having the target T disposed therein and in which the proximal end side of the anode 61 (target supporting portion 60) is fixed by the housing coupling portion 15; and the cover electrode 19 which is disposed inside the vacuum housing 10, is coupled to the anode 61 (target supporting portion 60) by the cover coupling portion 70, and surrounds the housing coupling portion 15. The anode 61 (target supporting portion 60) has the third diameter increasing portion 60*f* (flange portion) protruding from the front surface of the main body portion in the direction intersecting the tube axis AX. The cover coupling portion 70 is disposed closer to the proximal end side of the anode 61 than the third diameter increasing portion 60*f*.

The state of an electric field generated inside the vacuum housing 10 is affected by the shape of the front surface, the state of the front surface, and the like of the fixing portion of each member. Here, the housing coupling portion 15 of the X-ray tube 3 fixes the anode 61 to the vacuum housing 10. The housing coupling portion 15 is surrounded by the cover electrode 19. On the other hand, the cover electrode 19 is fixed to the anode 61 by the cover coupling portion 70. The cover coupling portion 70 is disposed closer to the proximal end side of the anode 61 than the third diameter increasing portion 60*f* provided in the anode 61. As a result, the housing coupling portion 15 serving as a fixing portion for fixing the anode 61 to the vacuum housing 10, and the cover coupling portion 70 serving as a fixing portion for fixing the cover electrode 19 to the anode 61 are disposed at positions covered with the electrodes having the same potential. For example, the electrodes having the same potential are the cover electrode 19 and the third diameter increasing portion 60*f*. Therefore, an influence on an electric field inside the vacuum housing 10 can be alleviated. As a result, a local increase in the intensity of an electric field is curbed. That is, electric discharge can be curbed.

The third diameter increasing portion 60*f* comes into contact with the cover electrode 19. According to this configuration, the third diameter increasing portion 60*f* and the cover electrode 19 approach each other. As a result, electric fields around the flange portion and the cover electrode are easily stabilized. In addition, positioning of the cover electrode 19 can be reliably performed.

The outer surface of the third diameter increasing portion 60*f* includes the front surface 60*f*2 exposed to the inner space of the vacuum housing 10. The outer surface of the cover electrode 19 includes the front surface 19*f* (second main surface) exposed to the inner space of the vacuum housing 10. The front surface 60*f*2 and the front surface 19*f* are included in the same virtual curved surface. According to this configuration, a boundary between the third diameter increasing portion 60*f* and the cover electrode 19 becomes smooth. Therefore, an influence of the boundary part on an electric field can be alleviated. As a result, a local increase in the intensity of an electric field is further curbed. That is, electric discharge can be further curbed.

The cover coupling portion 70 is surrounded by the cover electrode 19. According to this configuration, an electric field around the cover coupling portion 70 can be further stabilized.

The housing coupling portion 15 includes the second fixing portion 17 fixed to the vacuum housing 10, and the first fixing portion 16 fixed to the anode 61 (target supporting portion 60). The first fixing portion 16 is fixed to the second fixing portion 17. According to this configuration, the first fixing portion 16 and the second fixing portion 17 can bear internal stress caused by the vacuum housing 10 and the anode 61 (target supporting portion 60) being coupled to each other. Therefore, generation of unnecessary deformation and stress in the vacuum housing 10 and the anode 61 (target supporting portion 60) can be curbed.

The vacuum housing 10 includes the inner cylinder portion 12*a* extending inward along the tube axis AX. The inside of the inner cylinder portion 12*a* and the inside of the vacuum housing 10 are isolated from each other by the anode 61 (target supporting portion 60) and the housing coupling portion 15 provided in the one end portion of the inner cylinder portion 12*a*. A part in which the second fixing portion 17 is joined to the first fixing portion 16 is disposed inside the inner cylinder portion 12*a*. According to this configuration, the part in which the second fixing portion 17 is joined to the first fixing portion 16 is disposed inside the inner cylinder portion 12*a*. The part in which the second fixing portion 17 is joined to the first fixing portion 16 is the joint portion B2, for example. Therefore, the cooling medium provided from the outside easily enters the inside of the inner cylinder portion 12*a*. As a result, heat generated in the anode 61 can be efficiently discharged.

Hereinabove, the embodiment of the present invention has been described. The present invention is not limited to the foregoing embodiment. The present invention can be variously modified within a range not departing from the gist thereof.

The cover electrode 19 of the X-ray tube 3 according to the embodiment is sandwiched between the third diameter increasing portion 60*f* and the third fixing portion 18. Due to this structure, the cover electrode 19 is fixed to the anode 61 (target supporting portion 60). The structure in which the cover electrode 19 is fixed to the anode 61 (target supporting portion 60) may be a cover coupling portion 70A included in an X-ray tube 3A of a first modification example. In addition, a fixing structure may be a cover coupling portion 70B included in an X-ray tube 3B of a second modification example. Moreover, a fixing structure may be a cover coupling portion 70C included in an X-ray tube 3C of a third modification example.

First Modification Example

Figure 3:
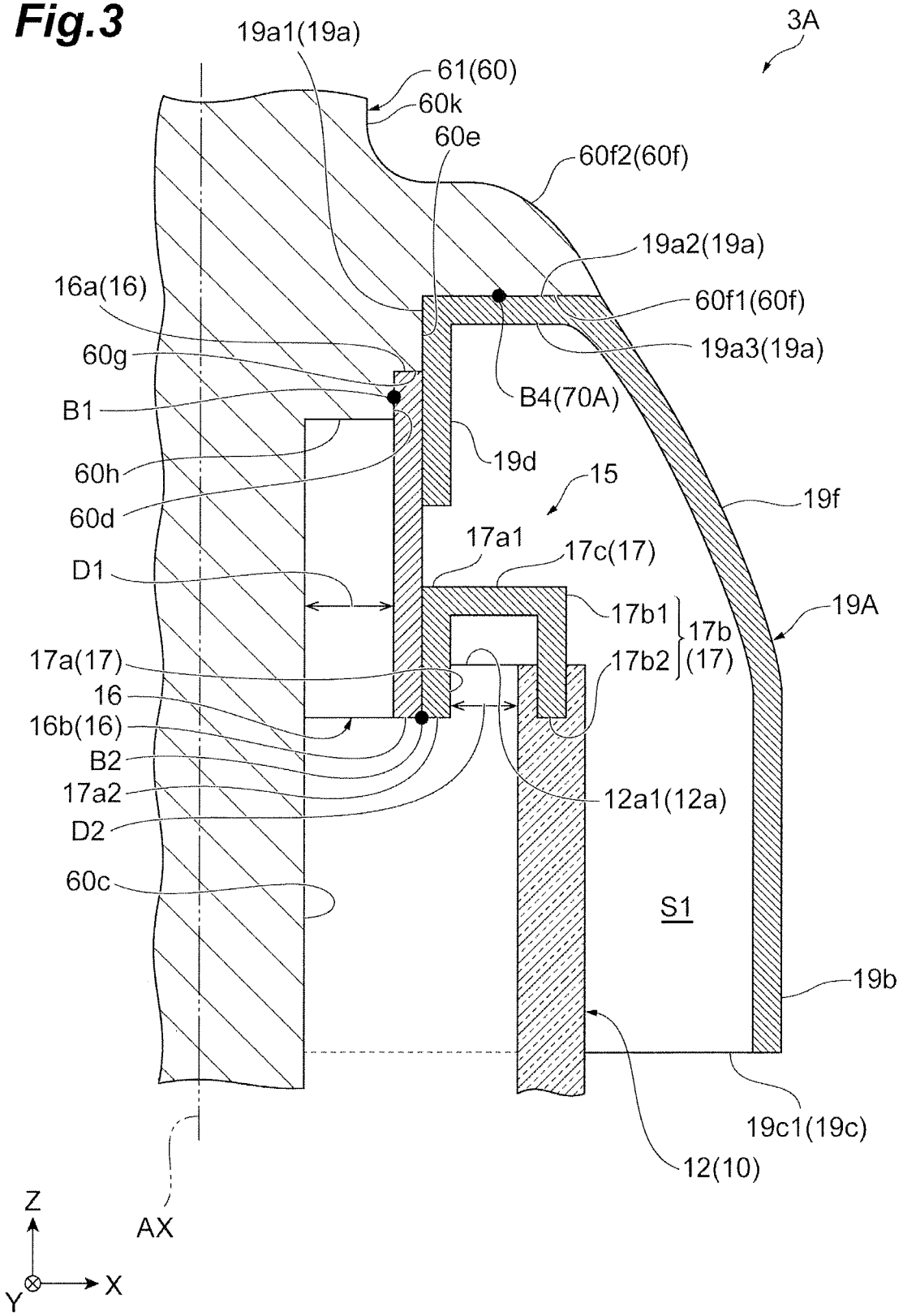
FIG. 3 is an enlarged cross-sectional view illustrating a housing coupling portion and a cover coupling portion according to a first modification example.

As illustrated in FIG. 3, the X-ray tube 3A of the first modification example has the cover coupling portion 70A. The cover coupling portion 70A causes the ring portion 19*a* to be directly joined to the rear surface 60*f*1 of the third diameter increasing portion 60*f* through brazing, welding, or the like.

Specifically, a cover electrode 19A has a cylinder portion 19*d*. The cylinder portion 19*d* extends in the direction of the tube axis AX from the ring portion 19*a*. For example, the shape of the cylinder portion 19*d* is the same as that of the third fixing portion 18. The inner circumferential surface of the cylinder portion 19*d* is in contact with the second diameter increasing portion 60*e* and the first fixing portion 16. The length of the cover electrode 19A in contact with the anode 61 (target supporting portion 60) and the first fixing portion 16 increases. For example, when the cylinder portion 19*d* is not included, the length in which the cover electrode 19 and the second diameter increasing portion 60*e* are in contact with each other is the thickness of the ring portion 19*a*. According to the cylinder portion 19*d*, the cover electrode 19A can be stably fixed to the anode 61 (target supporting portion 60).

The cover coupling portion 70A joins the main surface 19*a*2 of the ring portion 19*a* to the rear surface 60*f*1 of the third diameter increasing portion 60*f*. The main surface 19*a*2 of the cover coupling portion 70A is joined to the rear surface 60*f*1 by a joint portion B4. The joint portion B4 is formed through brazing, welding, or the like. The joint portion B4 is not exposed to a boundary between the front surface 60*f*2 and the front surface 19*f*. The inner circumferential surface of the cylinder portion 19*d* of the cover coupling portion 70A may be directly joined to the second diameter increasing portion 60*e* by the joint portion B4 or the like. The inner circumferential surface of the cylinder portion 19*d* may be further joined to the outer circumferential surface of the first fixing portion 16. According to this configuration, the cover coupling portion 70A joins the cover electrode 19A to the anode 61 (target supporting portion 60). Therefore, the number of components can be reduced.

Second Modification Example

Figure 4:
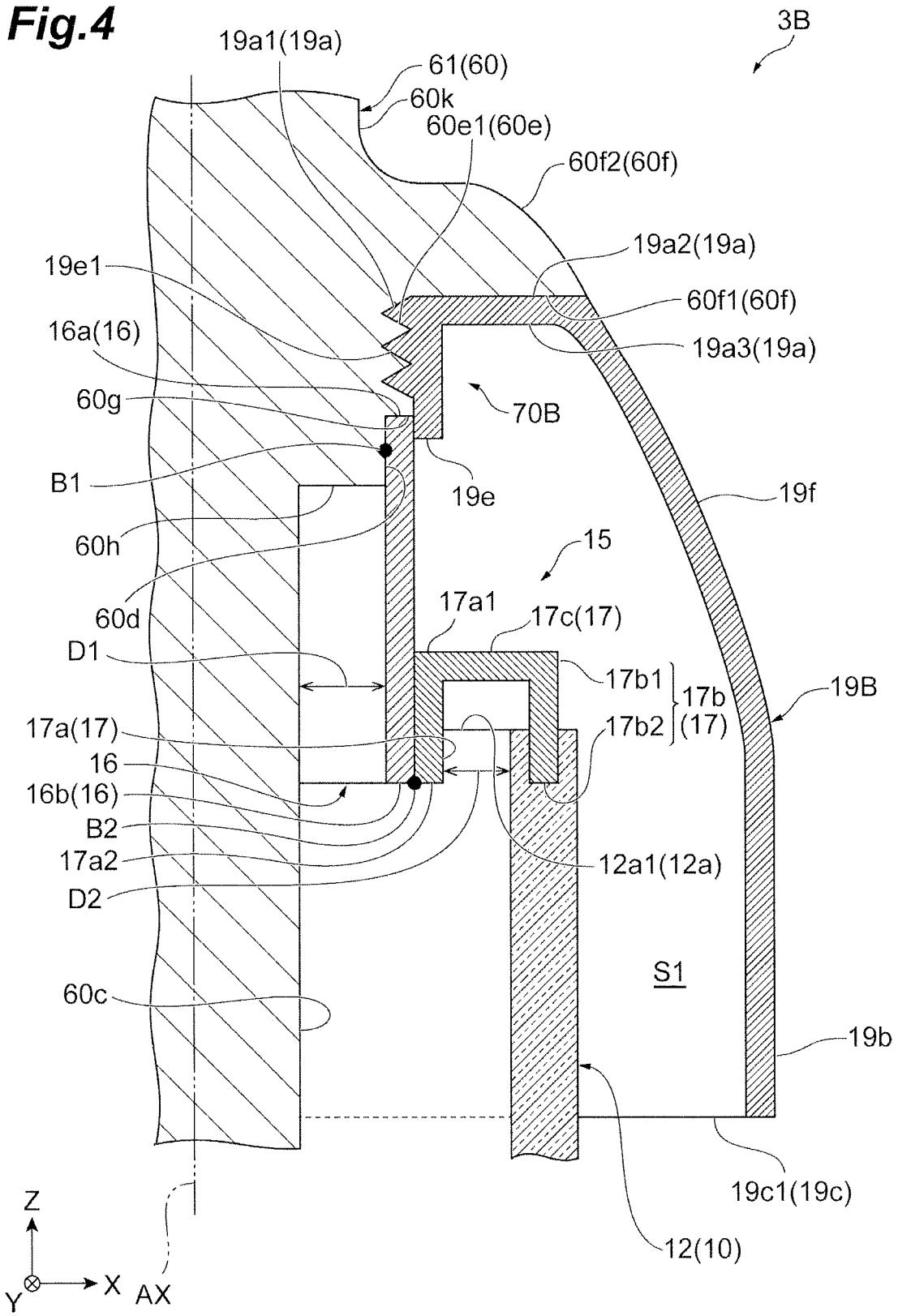
FIG. 4 is an enlarged cross-sectional view illustrating a housing coupling portion and a cover coupling portion according to a second modification example.

As illustrated in FIG. 4, the X-ray tube 3B of the second modification example has the cover coupling portion 70B. Similar to the cover coupling portion 70 of the first modification example, the cover coupling portion 70B directly fixes a cover electrode 19B to the anode 61 (target supporting portion 60). The cover coupling portion 70B fixes the cover electrode 19B to the anode 61 (target supporting portion 60) using a screw structure. The cover electrode 19B has a cylinder portion 19*e*. The cylinder portion 19*e* has a female screw 19*e*1 provided on the inner circumferential surface. The second diameter increasing portion 60*e* of the anode 61 (target supporting portion 60) has a male screw 60*e*1 provided on the outer circumferential surface. The female screw 19*e*1 of the cylinder portion 19*e* is screwed to the male screw 60*e*1. As a result, the anode 61 (target supporting portion 60) is fixed to the cover electrode 19B. According to the cover coupling portion 70B, the cover electrode 19B can be easily attached to the anode 61 (target supporting portion 60).

Third Modification Example

Figure 5:
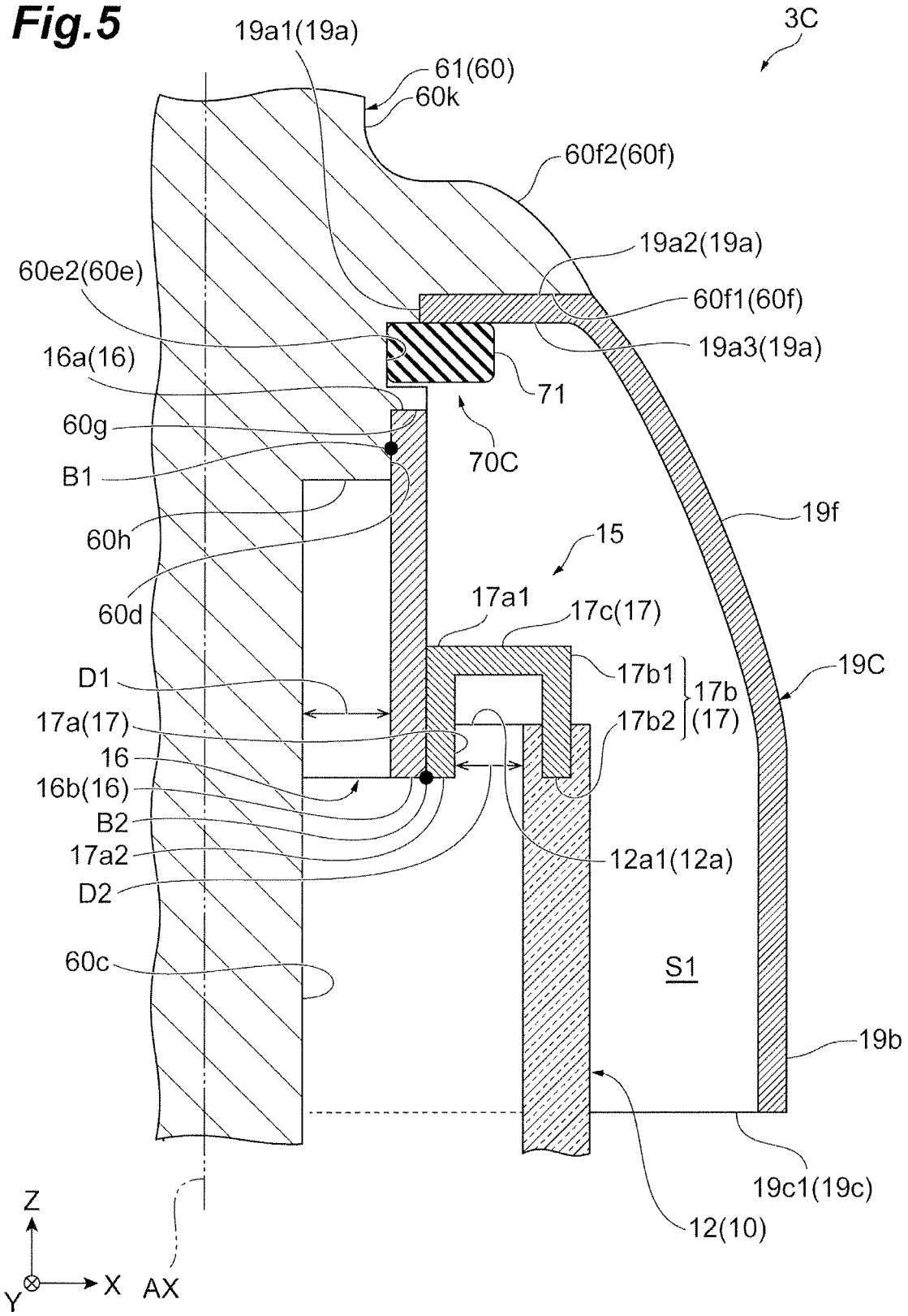
FIG. 5 is an enlarged cross-sectional view illustrating a housing coupling portion and a cover coupling portion according to a third modification example.

As illustrated in FIG. 5, the X-ray tube 3C of the third modification example has the cover coupling portion 70C. The cover coupling portion 70C does not directly fix a cover electrode 19C to the anode 61 (target supporting portion 60) as in the cover electrode 19B of the second modification example. The X-ray tube 3C is in common with the X-ray tube 3 in regard to using a fixing component. The cover coupling portion 70C of the third modification example includes a so-called C-ring 71 and a groove 60*e*2. The groove 60*e*2 is provided in the second diameter increasing portion 60*e*. The C-ring 71 is fitted to the groove 60*e*2. According to this fitting, the position of the C-ring 71 with respect to the anode 61 (target supporting portion 60) in the direction of the tube axis AX is determined. An outer circumferential edge of the C-ring 71 is larger than the inner diameter of the ring portion 19*a*. A main surface of the C-ring 71 faces the rear surface 19*a*3 of the ring portion 19*a*. The inner side of the C-ring 71 is fitted into the groove 60*e*2. Therefore, the C-ring 71 does not move with respect to the anode 61 (target supporting portion 60) in the direction of the tube axis AX. The ring portion 19*a* is sandwiched between the rear surface 60*f*1 of the third diameter increasing portion 60*f* and the main surface of the C-ring 71. The cover electrode 19C can be easily attached to the anode 61 (target supporting portion 60) even by the cover coupling portion 70C.

What is claimed is:

1. An X-ray tube comprising:

a rod-shaped anode which includes a main body portion extending in a direction of an axis line and a target generating X-rays upon receiving electrons;

a vacuum housing which accommodates a distal end side of the anode having the target disposed therein and in which a proximal end side of the anode is fixed by a housing coupling portion; and a cover electrode which is disposed inside the vacuum housing, is coupled to the anode by a cover coupling portion, and surrounds the housing coupling portion, wherein the anode has a flange portion protruding from a front surface of the main body portion in a direction intersecting the axis line, wherein the anode has an extension portion extending from the flange portion, the extension portion including the target on a distal end, wherein the anode has a columnar portion extending from the flange portion in a direction opposite the extension portion, the columnar portion including a proximal end portion disposed outside the vacuum housing, and wherein the cover coupling portion is disposed closer to the proximal end side of the anode than the flange portion.

2. The X-ray tube according to claim 1, wherein the flange portion and the cover electrode come into contact with each other.

3. The X-ray tube according to claim 1, wherein an outer surface of the flange portion includes a first main surface exposed to an inner space of the vacuum housing, wherein an outer surface of the cover electrode includes a second main surface exposed to the inner space of the vacuum housing, and wherein the first main surface and the second main surface are included in the same virtual curved surface.

4. The X-ray tube according to claim 1, wherein the cover coupling portion is surrounded by the cover electrode.

5. The X-ray tube according to claim 1, wherein the cover coupling portion joins the cover electrode to the flange portion.

6. The X-ray tube according to claim 1, wherein the housing coupling portion includes a housing coupling member fixed to the vacuum housing, and an anode coupling member fixed to the anode, and wherein the anode coupling member is fixed to the housing coupling member.

7. The X-ray tube according to claim 6, wherein the vacuum housing includes an inner cylinder portion extending inward along the axis line, wherein an inside of the inner cylinder portion and an inside of the vacuum housing are isolated from each other by the anode and the housing coupling portion provided in one end portion of the inner cylinder portion, and wherein a part in which the anode coupling member is joined to the housing coupling member is disposed inside the inner cylinder portion.

8. The X-ray tube according to claim 1, wherein the anode and the cover electrode are separate and distinct parts, and wherein the cover coupling portion couples the anode with the cover electrode.

9. The X-ray tube according to claim 1, wherein the flange portion includes a first main surface that is an outer surface and exposed to an inner space of the vacuum housing, and a rear surface facing the proximal end, wherein an outer surface of the cover electrode includes a second main surface exposed to the inner space of the vacuum housing, and wherein the cover coupling portion is disposed on the first main surface, the second main surface, and a region stipulated by a surface of the columnar portion and the rear surface of the flange portion.

* * * * *